US006550626B1

(12) United States Patent
Randall

(10) Patent No.: US 6,550,626 B1
(45) Date of Patent: Apr. 22, 2003

(54) CLOSURE LID AND RESEALABLE CLOSURE SYSTEM WITH TAMPER-EVIDENT FEATURES

(75) Inventor: Jeffrey T. Randall, Oconomowoc, WI (US)

(73) Assignee: Seaquist Closures Foreign, Inc., Crystal Lake, IL (US)

( * ) Notice: Subject to any disclaimer, the term of this patent is extended or adjusted under 35 U.S.C. 154(b) by 107 days.

(21) Appl. No.: 09/678,361

(22) Filed: Oct. 3, 2000

(51) Int. Cl.[7] ..... B65D 47/00

(52) U.S. Cl. ..... 215/253; 215/254; 220/259.1; 220/259.2; 222/541.5; 222/541.6; 222/556

(58) Field of Search ..... 215/237, 253, 215/254; 220/254.2, 254.3, 259.1, 259.2, 847; 222/541.5, 541.6, 541.9, 556

(56) References Cited

U.S. PATENT DOCUMENTS

| | | | | | |
|---|---|---|---|---|---|
| 3,255,928 | A | * | 6/1966 | Foster | 215/237 |
| 3,587,944 | A | * | 6/1971 | Pehr | 220/259.2 |
| 4,436,212 | A | | 3/1984 | Liera | |
| 4,462,504 | A | * | 7/1984 | Roth et al. | 215/235 |
| 4,519,517 | A | * | 5/1985 | Walter | 215/209 |
| 4,592,480 | A | * | 6/1986 | Hart et al. | 220/270 |
| 4,795,044 | A | * | 1/1989 | Beck | 215/237 |
| 4,860,907 | A | * | 8/1989 | Sondal | 215/230 |
| 4,919,286 | A | | 4/1990 | Agbay, Sr. | |
| 5,207,783 | A | | 5/1993 | Burton | |
| 5,386,918 | A | * | 2/1995 | Neveras et al. | 215/235 |
| 5,662,245 | A | * | 9/1997 | Grant | 220/254.3 |
| 5,810,212 | A | * | 9/1998 | Santagiuliana | 215/237 |
| 5,875,942 | A | | 3/1999 | Ohmi et al. | |
| 6,116,441 | A | | 9/2000 | Decelles et al. | |

FOREIGN PATENT DOCUMENTS

WO WO 98/56675 12/1998

WO WO 00/76875 A1 12/2000

OTHER PUBLICATIONS

International Search Report in PCT/US01/29722, filed Sep. 21, 2001.

* cited by examiner

*Primary Examiner*—Jes F. Pascua
(74) *Attorney, Agent, or Firm*—Wood, Phillips, Katz, Clark & Mortimer

(57) ABSTRACT

A tamper-evident structure for use in a resealable dispensing closure system includes a lid and a flexible, frangible tamper-evident member extending from the lid to a drop ring. The drop ring is adapted to engage a bottom end of a closure body in the closure system. Preferably, the lid, frangible tamper-evident member, and drop ring are provided as a unitary, integrally molded structure. In a preferred embodiment, the closure body can also be molded as a unitary part of the structure. The lid, frangible tamper-evident member and drop ring are assembled on the closure body by first installing the lid in a closed position on the closure body. The drop ring is then pivoted downward relative to the lid, thereby causing the frangible tamper-evident member to become disposed adjacent the closure body skirt. The drop ring is located at the bottom of the closure body. The system can then be installed on a container so that the drop ring locks under a bead or lip on the container. If the closure body is subsequently removed from the container, a part of the frangible tamper-evident member is severed because the drop ring is prohibited from moving upward as the closure body is removed. Moreover, if the lid is moved away from its closed position relative to the closure body when the closure body is still on the container, then another part of the frangible tamper-evident member is severed because the drop ring, and therefore the frangible tamper-evident member, are prohibited from moving upward. Thus, the single tamper-evident feature in the form of the frangible tamper-evident member provides evidence of tampering with 1) the closure body relative to the container, and 2) the lid relative to the closure body.

18 Claims, 8 Drawing Sheets

FIG. 10
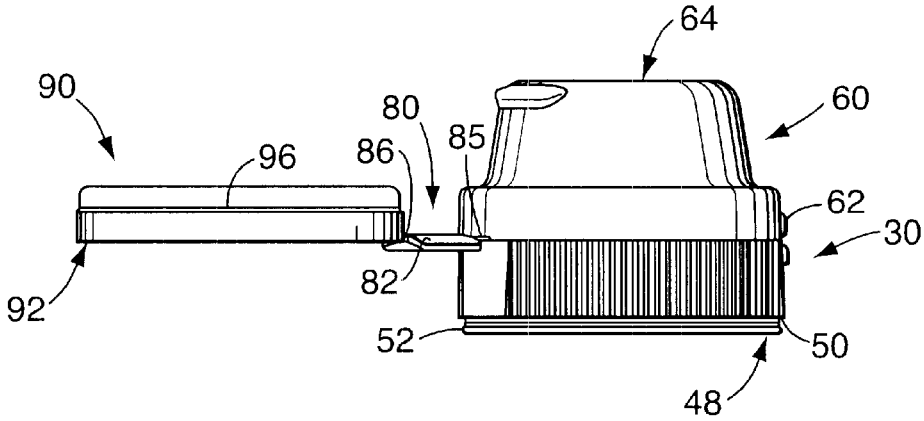
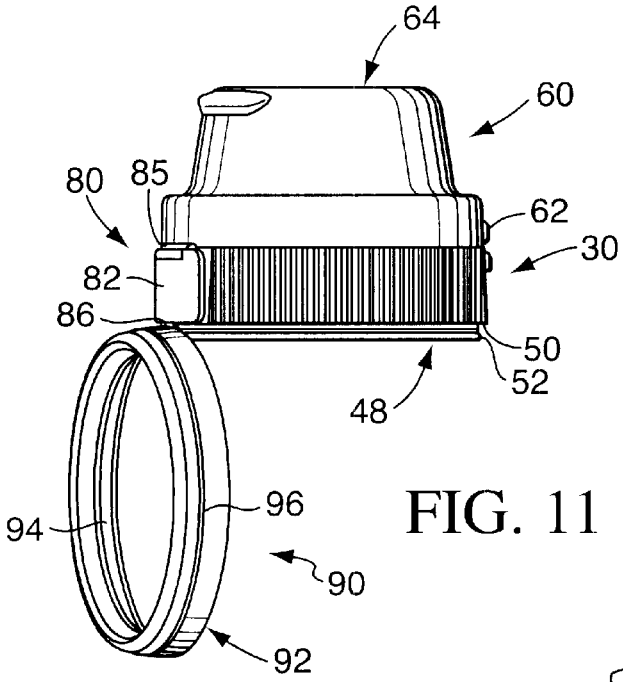
FIG. 11
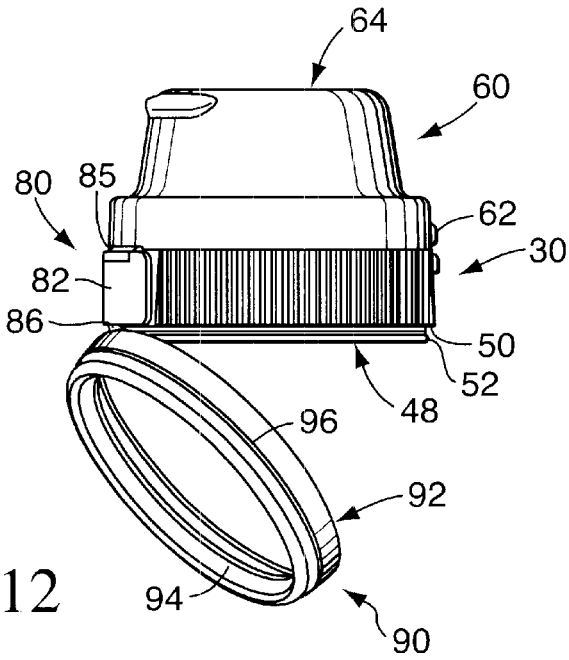
FIG. 12

CLOSURE LID AND RESEALABLE CLOSURE SYSTEM WITH TAMPER-EVIDENT FEATURES

CROSS REFERENCE TO RELATED APPLICATION(S)

Not applicable.

STATEMENT REGARDING FEDERALLY SPONSORED RESEARCH OR DEVELOPMENT

Not applicable.

REFERENCE TO A MICROFICHE APPENDIX

Not applicable.

TECHNICAL FIELD

The invention relates to resealable dispensing closure systems that incorporate tamper-evident features. More particularly, the invention relates to closure lids that incorporate tamper-evident features, to resealable dispensing closure systems that combine such lids with a closure body and to methods for assembling such closure systems.

BACKGROUND OF THE INVENTION AND TECHNICAL PROBLEMS POSED BY THE PRIOR ART

Various types of resealable dispensing closure systems are generally known in the prior art. They typically include a closure body provided with a dispensing orifice of suitable dimension and a closure lid for resealing the dispensing orifice. Frequently, the closure lid cooperates with the closure body through a hinge and the closure body, hinge and lid may molded as a unitary, integrated structure.

It is also known to incorporate tamper-evident features into resealable dispensing closure systems in order to detect post-installation tampering with the closure system. Prior art tamper-evident features typically include a drop ring that is integrally molded with and frangibly connected to the bottom of the closure body. The frangible connection is often provided by a membrane that extends around the closure body and which is provided with intermittent slits or an area of reduced thickness. Typically, such prior art drop rings are adapted to engage a drop ring bead which is molded into the container finish on a container with which the closure system is used. The drop ring bead is usually configured with an inclined surface to deform the drop ring in a radially outward direction to permit the drop ring to pass downward over the drop ring bead when the closure body is first installed on the container. The drop ring bead is also usually configured with a shoulder which abuts a corresponding surface on the drop ring to prohibit upward movement of the drop ring when the closure body unscrewed or otherwise moved relative to the container. Thus, after the initial installation of the closure, when the closure is initially opened or tampered with, the frangible connection is broken and the drop ring is wholly or partially severed from the closure body.

Known resealable dispensing closure systems that incorporate the above-described tamper-evident features are characterized by a number of disadvantages. One disadvantage is that known tamper-evident drop rings of the prior art, while suitable for evidencing movement of the closure body relative to the container, do not typically provide evidence of tampering of a resealable lid which may be provided on the closure body. For this reason, closure systems which incorporate a resealable lid are typically provided with additional tamper-evident features, for example, heat-shrinkable thermoplastic bands or perforated connections between the lid and closure body, to evidence tampering with the lid relative to the closure body. This results in increased cost and manufacturing time.

Another disadvantage of known resealable closure systems which incorporate tamper-evident features is that manufacturing, especially molding, of the tamper-evident features is often complex. For example, in the case of the above-described closure systems, the drop ring is molded as an integral portion of the closure body, but with a frangible connection which often involves rather complex mold configurations or complex molding techniques. In other tamper-evident closure systems, tamper-evident features are typically provided as parts which are separate from the primary closure structure and must therefore be assembled onto the primary closure structure after the closure structure is molded. Such manufacturing complexity increases the amount of manufacturing time and the associated expense of known closure systems.

It would therefore be advantageous to provide an improved closure lid with tamper-evident features and which, when used in a closure system with a closure body, provides evidence of tampering with the closure body relative to the container as well as evidence of tampering with the lid relative to the closure body. It would also be advantageous to provide such an improved closure lid and closure system which are easy and inexpensive to manufacture compared to the prior art.

It would also be advantageous if such an improved closure lid and associated closure system could accommodate bottles, containers, or packages which have a variety of shapes and that are constructed from a variety of materials. Further, it would be desirable if such an improved system could accommodate efficient, high-quality, large volume manufacturing techniques with a reduced product reject rate to produce a system with consistent operating characteristics.

BRIEF SUMMARY OF THE INVENTION

The present invention provides an improved closure lid and dispensing closure system with tamper-evident features which addresses the aforementioned disadvantages in the prior art. The invention also provides an improved method of assembling a closure system. In particular, the present invention provides a tamper-evident closure lid and resealable dispensing closure system in which a single tamper-evident member or band is utilized to provide evidence of tampering with the closure body relative to the container as well as evidence of tampering with the resealable lid relative to the closure body. Moreover, the invention provides a closure lid and tamper-evident, resealable dispensing closure system that is simple and inexpensive to manufacture and assemble compared to prior art closure lids and closure systems.

The invention provides a closure lid with tamper-evident features, the lid being adapted to be used in one preferred form of a dispensing closure system that includes a closure body having a closure body skirt including at least one thread and extending to a closure body skirt bottom. The lid includes a lid skirt extending to a skirt bottom and may cooperate with the closure body through a hinge or may be separate from the closure body. A tamper-evident member in the form of a flexible, frangible tether member extends from the lid skirt and has a distal end and a proximal end. The proximal end is attached to the lid near or at the lid skirt and the distal end is attached to a drop ring. Preferably, the lid, frangible tether member and drop ring are provided as a unitary, integrally molded structure. As molded, the lid skirt bottom, frangible tether member and drop ring each have a surface portion which are all preferably substantially coplanar. The frangible tether member is of sufficient length to permit the drop ring to be positioned on the closure body skirt bottom when the closure system is configured into an assembled position. The drop ring preferably cooperates with the closure body skirt bottom through a fastening feature, which may be a snap-fit feature, to retain the drop ring on the closure body skirt bottom.

According to the inventive method, the molded lid, frangible tether member and drop ring are assembled on the closure body by first installing the lid in a closed position on the closure body. The drop ring is then pivoted downward relative to the lid, thereby causing the frangible tether member to become disposed adjacent the closure body skirt. The drop ring is snap-fit into place on the bottom of the closure body skirt to form a tamper-evident closure assembly. As the closure assembly is installed on a container having a threaded finish, the closure body is screwed onto the container and, as the closure body moves downward, with the drop ring is initially deformed by a drop ring lip provided on the container finish. Once the closure body moves to a fully installed position, the drop ring returns to its undeformed state and is retained by an abutting surface on the drop ring lip.

If the closure body is unscrewed from the container, the frangible tether member is severed since the drop ring is prohibited from moving upward by the container drop ring lip as the closure body is unscrewed. Moreover, if the lid is moved from its closed position relative to the closure body, the frangible tether member is severed since the drop ring, and therefore the frangible tether member, are prohibited from moving upward. Thus, the single tamper-evident feature in the form of the frangible tether member provides evidence of tampering with 1) the closure body relative to the container, and 2) the lid relative to the closure body.

The tamper-evident lid and closure system according to the invention also provide ease of manufacture and assembly. The molded configuration of the lid, frangible tether member and drop ring is relatively simple compared to prior art molded configurations, owing in part to the coplanar relationship of portions of the molded lid, frangible tether member and drop ring. Moreover, ease of assembly of closure systems incorporating the lid according to the invention is facilitated by the fastening feature provided on the drop ring. Thus, closure systems incorporating the inventive lid may be manufactured with less effort and expense than was required in prior art closure systems.

According to one primary aspect, the invention provides a tamper-evident structure for use in a closure system that includes a closure body having a dispensing orifice. The tamper-evident structure comprises (A) a lid for occluding the dispensing orifice, (B) a frangible tamper-evident member extending from a proximal end adjacent the lid to a distal end opposite the proximal end, and (C) a drop ring attached to the distal end of the frangible tether member.

According to another primary aspect, the invention provides a closure lid and tamper-evident feature combination for use on a closure system, the closure system including a closure body having a dispensing orifice, the combination comprising (A) a lid adapted to be moved between (1) a closed position in which the lid engages the closure body to occlude the dispensing orifice, and (2) an open position in which the lid is spaced away from the closure body, and (B) a tamper-evident feature integrally molded to form a unitary construction with the lid and including (1) a drop ring, and (2) a frangible tamper-evident member extending between the drop ring and the lid.

According to another primary aspect, the invention provides a method of assembling a tamper-evident closure system comprising (A) the step of integrally molding the closure system to form a unitary construction, the closure system including: (1) a closure body having a dispensing orifice for permitting flow through the closure body and a skirt defining a skirt bottom; (2) a lid having an as-molded condition in which it is in an open position relative to said closure body; and (3) a tamper-evident feature extending from the lid and including (a) a frangible tamper-evident member affixed to the lid, and (b) a drop ring affixed to the frangible tamper-evident member; (B) the step of moving the lid from the molded position to a closed position in which the lid engages the closure body and occludes the dispensing orifice; and (C) the step of fastening the drop ring to the skirt bottom and thereby orienting the frangible tamper-evident member adjacent the skirt, the frangible tamper-evident member thereby tending to fracture upon relative movement of the lid relative to the closure body and upon relative movement of the closure body relative to the drop ring.

Numerous other advantages and features of the present invention will become readily apparent from the following detailed description of the invention, from the claims, and from the accompanying drawings.

BRIEF DESCRIPTION OF THE DRAWINGS

The accompanying drawings form part of the specification, and like numerals are employed to designate like parts throughout the same.

FIG. 10 is an elevational view of the exemplary lid and closure system of FIG. 1, configured in a first intermediate assembly position in which the closure lid has been pivoted to a closed position on a closure body;

FIG. 11 is an elevational view of the exemplary lid and closure system of FIG. 1, configured in a second intermediate assembly position in which the frangible tether member is pivoted to a position adjacent the closure body;

FIG. 12 is an elevational view of the exemplary closure system of FIG. 1, configured in a third intermediate assembly position in which the drop ring is pivoted towards a position in which it would engage the closure body;

DETAILED DESCRIPTION

While this invention is susceptible of embodiment in many different forms, this specification and the accompanying drawings disclose only some specific forms as examples of the invention. The invention is not intended to be limited to the embodiments so described, however. The scope of the invention is pointed out in the appended claims.

For ease of description, most of the figures illustrating the invention show a dispensing system in the typical orientation that it would have at the top of a container when the container is stored upright on its base, and terms such as upper, lower, horizontal, etc., are used with reference to this position. It will be understood, however, that the dispensing system of this invention may be manufactured, stored, transported, used, and sold in an orientation other than the position described.

The tamper-evident lid and closure system of this invention are suitable for use with a variety of conventional or special containers having various designs, the details of which, although not illustrated or described, would be apparent to those having skill in the art and an understanding of such containers. The container per se described herein forms no part of and therefore is not intended to limit the present invention. It will also be understood by those of ordinary skill that novel and non-obvious inventive aspects are embodied in the described exemplary closure systems alone.

Figure 1:
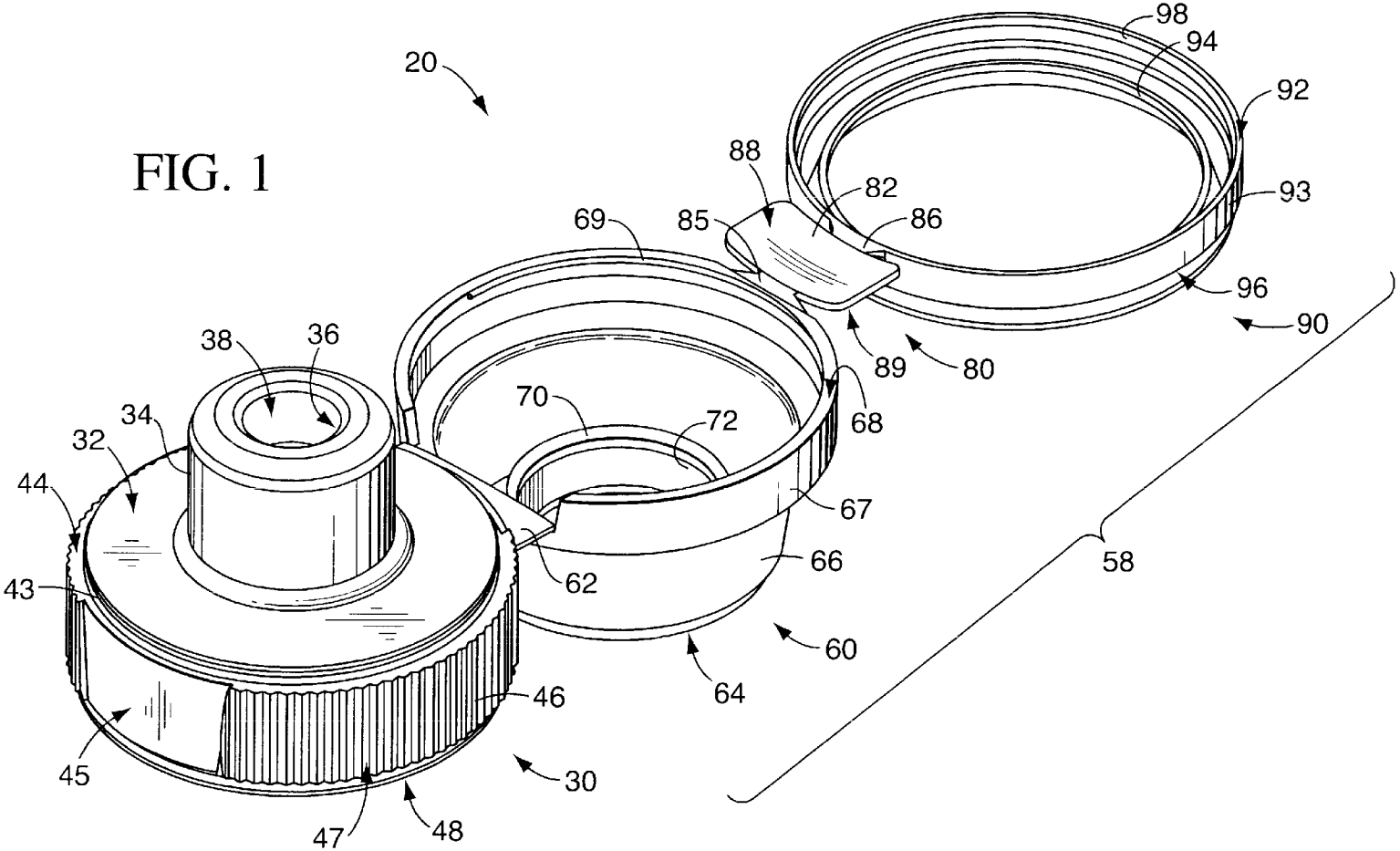
FIG. 1 is a perspective view of an exemplary lid and tamper-evident closure system according to a preferred embodiment of the invention shown in an as-molded, pre-assembly position.
Figure 2:
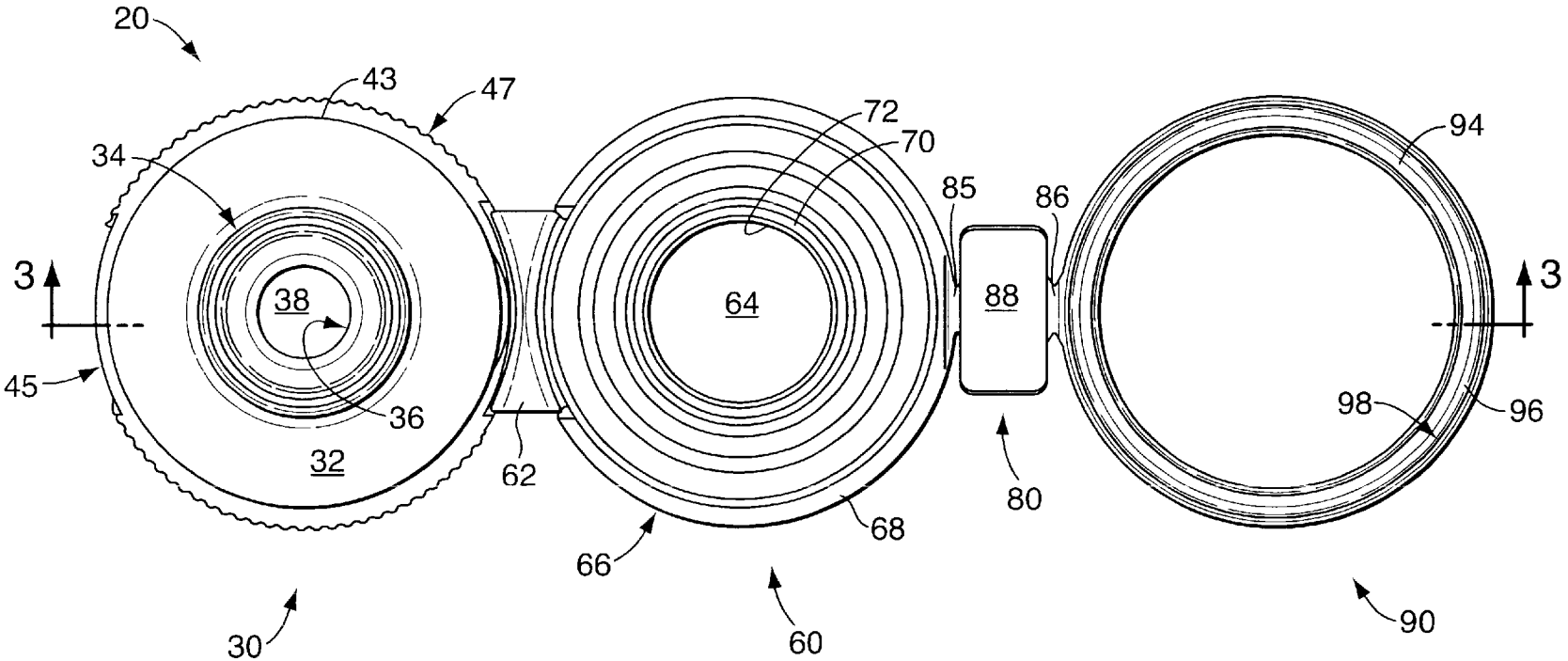
FIG. 2 is a top view of the lid and tamper-evident closure system shown in FIG. 1.

An exemplary embodiment of a tamper-evident lid, generally referenced by the number 60, according to the invention is illustrated in FIGS. 1–15 and is described in reference to a closure system, generally referenced by the number 20. Referring specifically to FIG. 1, it can be seen that the exemplary closure system 20 comprises two general components: 1) a closure body 30, and 2) a tamper-evident structure 58. The tamper-evident structure 58, in turn, comprises a lid 60, a tamper-evident member 80, and a drop ring 90. In accordance with the invention, the tamper-evident structure 58, including the lid 60, the tamper-evident member 80, and the drop ring 90, is provided as a unitary, integrally molded structure. Although the exemplary embodiment also provides the closure body 30 as an integrally molded component with the exemplary tamper-evident structure 58 wherein the tamper-evident structure 58 and closure body 30 are in cooperating relationship through an integrally molded hinge 62, the invention contemplates closure systems in which the tamper-evident structure 58 may be provided as a component molded separately from the closure body, and the invention contemplates closure systems in which the tamper-evident structure 58 need not cooperate with the closure body 30 through a hinge at all. Thus, the invention contemplates tamper-evident structures per se with or without a closure body, although additional inventive aspects will be recognized in closure systems which combine a tamper-evident structure having the inventive features with a closure body, such as the exemplary one described herein.

Figure 13:
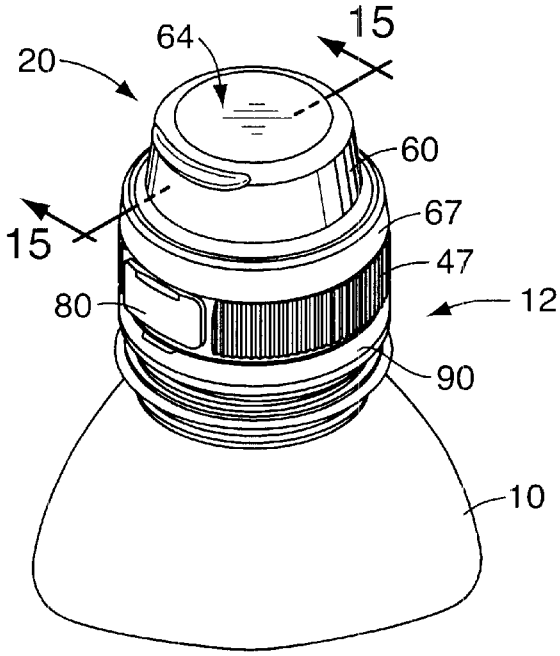
FIG. 13 is a perspective view of the exemplary closure system of FIG. 1, configured in a fully assembled position and installed on a container, which container forms no part of the invention.

Referring to FIGS. 1–3 and 7–15, the closure body 30 includes a closure deck 32 which has extending upward therefrom a cylindrical spout 34 having a dispensing orifice peripheral surface 36 defining a dispensing orifice 38 for permitting flow of contents from a container (FIG. 13). It will be recognized by those of ordinary skill that, although the exemplary embodiment is provided with a closure deck 32 that is generally planar, other closure deck configurations, such as dome-shaped closure decks, for example, are contemplated by the invention. Moreover, the invention contemplates closure bodies in which the closure deck may be reduced in size, owing to an enlarged spout, for example, and closure bodies in which a closure deck is absent from the closure body.

The closure body 30 also includes a closure body skirt 46 extending downward from the closure deck 32 and having at least one closure body thread 49 (FIGS. 3 and 15) formed on an interior surface thereof for engaging a container thread 16 (FIG. 14) on the neck 12 of a container 10. An undulating gripping surface 47 is provided on an outer portion of the closure body skirt 46 to enable a user to easily grip the closure body 30 and rotate it. An annular shoulder 44 is formed peripherally around the closure deck 32 for receiving the closure body lid 60 when the closure system 20 is assembled and the lid 60 is moved to a closed position (shown in FIGS. 10–15), as will be explained below. The annular shoulder 44 is provided with a lid-retaining bead 43 for securing the lid 60 in a closed position. In addition, a tamper-evident member receiving recess 45 is provided on the outer surface of the closure body skirt 46 for receiving a tamper-evident member when the closure system 20 is assembled, as will be explained below. The closure body skirt 46 extends downward to a closure body skirt end 48, which includes a closure body skirt shoulder 50 (FIGS. 3, 10–12 and 15) and a closure body skirt end snap-fit bead 52 (FIGS. 3, 10–12 and 15) formed therein. The closure body skirt shoulder 50 receives a closure body facing end 92 (FIGS. 1, 6 and 10–12) of the drop ring 90 when the closure system 20 is assembled, as will be described. The closure body skirt end snap-fit bead 52 cooperates with the drop ring 90 to secure the drop ring 90 to the closure body 30 when the closure system is assembled.

As will be recognized, the closure skirt 46 could be provided with some other container connecting means, such as a snap-fit bead or groove (not illustrated) in place of the thread 49 for engaging a container groove or bead (not illustrated), respectively, in the container neck.

The lid 60 cooperates with the closure body 30 through a hinge 62. The hinge 62 is preferably a snap action hinge such as that disclosed in the U.S. Pat. No. 5,642,824, the disclosure of which is incorporated herein by reference thereto. In an alternate embodiment, the lid 60 may be connected to the closure body 30 through a floppy hinge (not illustrated)

instead of the snap-action hinge. Moreover, as mentioned above, the hinge 62 may be eliminated altogether and the lid 60 may be completely separable from the closure body 30.

As best shown in FIGS. 1, 3, 4 and 15, the exemplary lid 60 includes a lid end wall 64 from which extends a lid skirt 66. The lid skirt 66 has an enlarged diameter bottom portion 67 which terminates at a lid skirt end 68 which includes a lid retaining bead 69 (FIGS. 1, 3, 4 and 15) formed therein for cooperating with the closure body lid retaining bead 43 to retain the lid 60 in a closed position on the closure body 30. In the closed position, the lid skirt end 68 engages the closure body annular shoulder 44. A lid inner wall 70 (FIGS. 1–3) extends from the lid end wall 64 and is provided with a lid inner wall seal bead 72 for sealingly engaging an outer surface of the spout 34 when the lid is in the closed position to occlude the dispensing orifice 38.

Preferably, the hinge 62, closure body 30 and lid 60 are integrally molded as a unitary construction. It will be understood, however, that the invention contemplates closure systems in which the lid 60 may pivotably cooperate with the closure body 30 through other implements in place of the integrally molded hinge 62. For example, the lid 60 may be molded separately from the closure body 30 and provided with a hinge pin (not shown) which cooperates with a yoke (not shown) molded into the closure body. As a further example, the lid 60 may be provided without any implements for pivotable attachment to the closure body 30, but may instead be completely detached from the closure body 30 or may cooperate with the closure body 30 through threaded features molded into the closure body 30 and the lid 60.

In accordance with the invention, as best shown in FIGS. 1–3, 5 and 7, the lid 60 includes a tamper-evident member 80 which comprises a frangible tether member 82 extending from the lid skirt bottom portion 67 and having a drop ring 90 attached thereto. The frangible tether member 82 has a proximal end 85 having a reduced thickness of material to provide a first weakened portion extending to the lid 60. The frangible tether member 82 also has a distal end 86, generally opposite the proximal end 85 and having a reduced thickness of material to provide a second weakened portion extending to the drop ring 90. As best seen in FIG. 1, the frangible tether member 82 is provided with a curved shape, having a concave surface 88 facing upward and a convex surface 89 facing downward in the as-molded condition. The curved shape of the frangible tether member 82 facilitates a flush mounting of the frangible tether member 82 within the member-receiving recess 47 on the closure body 30 when the closure system 20 is assembled as will be described below.

Figure 3:
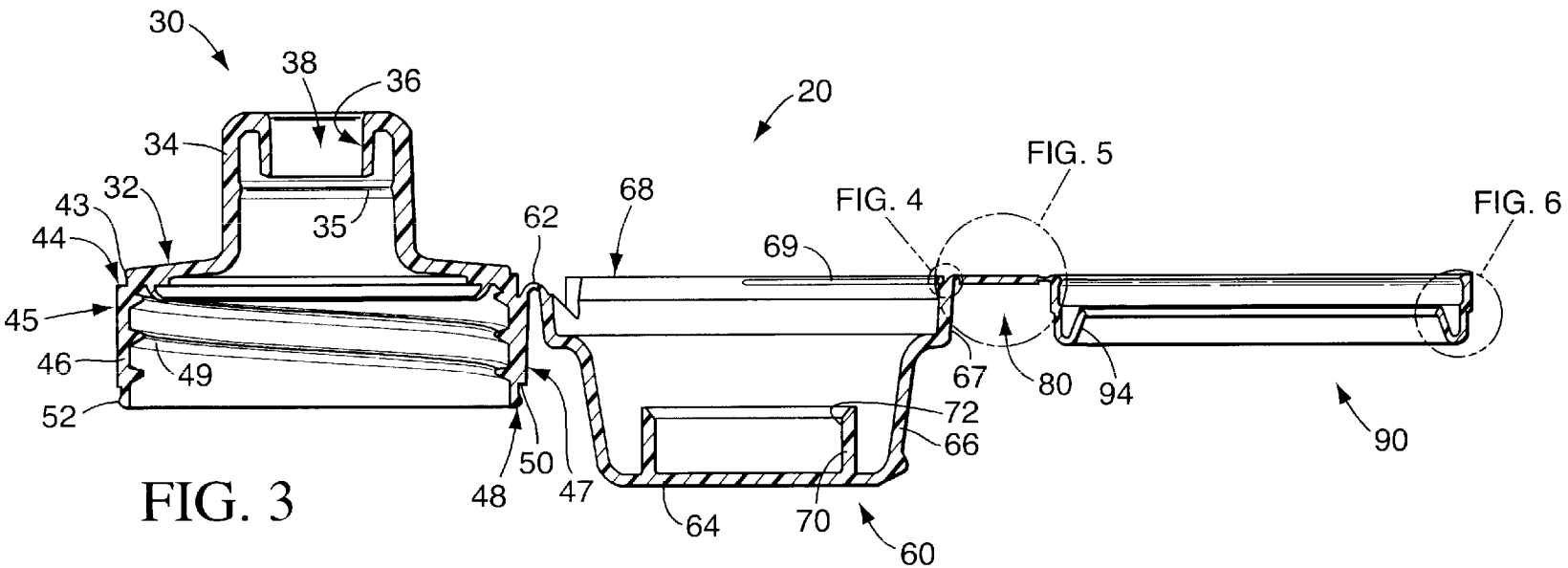
FIG. 3 is a cross-sectional view taken along the plane defined by line 3—3 in FIG. 2.
Figure 6:
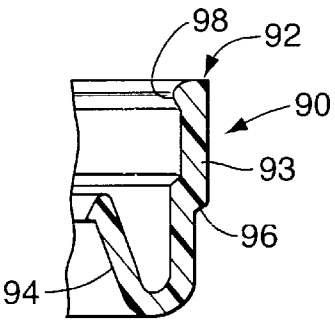
FIG. 6 is an enlarged portion of FIG. 3 as indicated therein and showing a cross-sectional view of a portion of the exemplary drop ring according to the invention.
Figure 5:
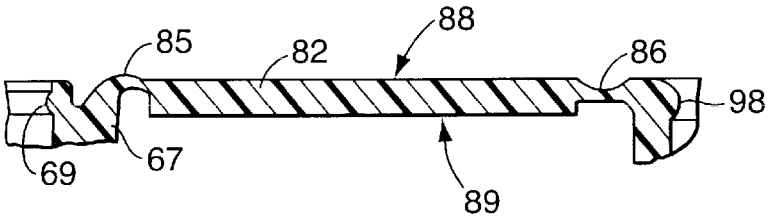
FIG. 5 is an enlarged portion of FIG. 3 as indicated therein and showing a cross-sectional view of the frangible tether member, the portion of an exemplary lid end and a portion of an exemplary drop ring according to the invention.
Figure 4:
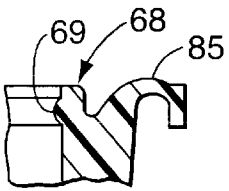
FIG. 4 is an enlarged portion of FIG. 3 as indicated therein and showing a cross-sectional view of a portion of an exemplary lid end and a portion of a frangible tether member according to the invention.
Figure 7:
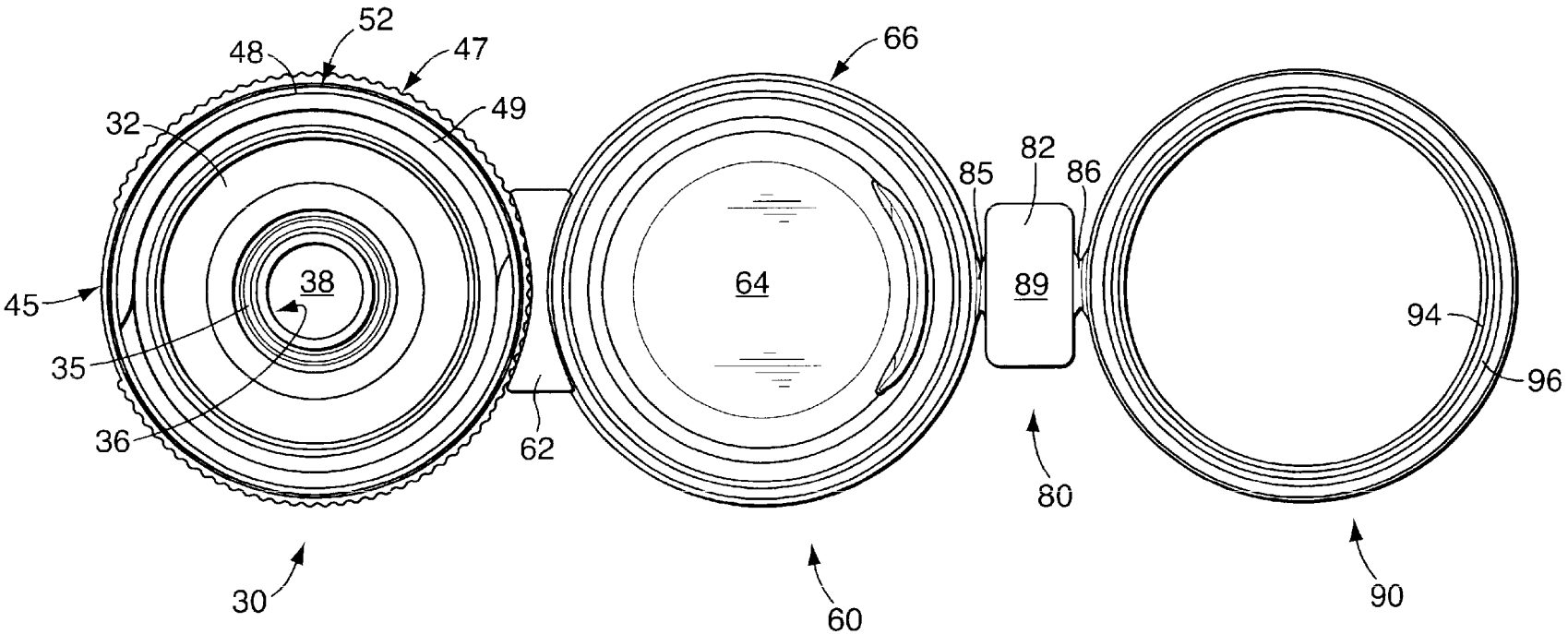
FIG. 7 is a bottom view of the tamper-evident lid and closure system shown in FIG. 1.
Figure 8:
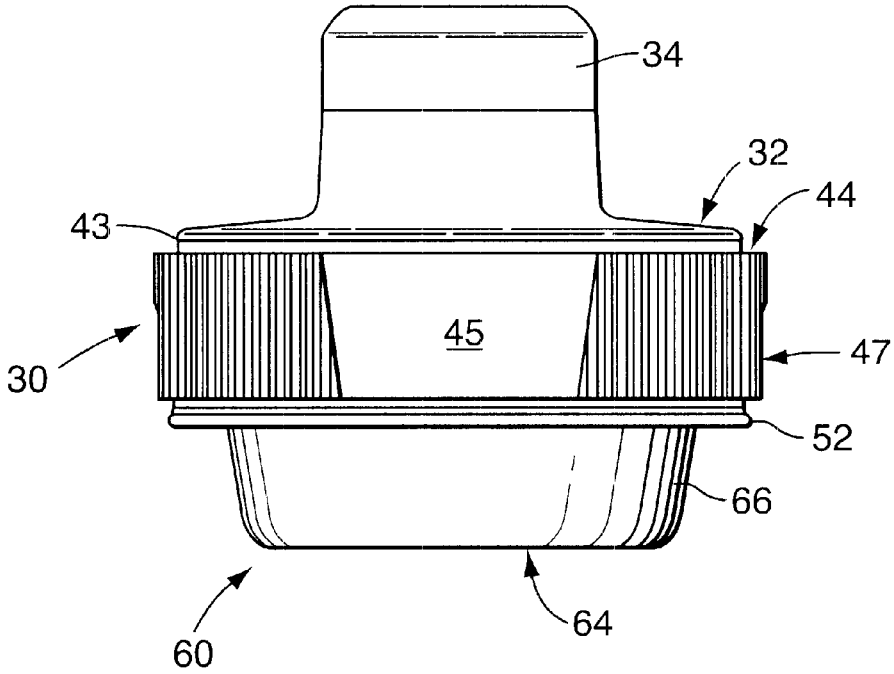
FIG. 8 is an elevational view of the left side of the exemplary lid and closure system shown in FIG. 1.
Figure 9:
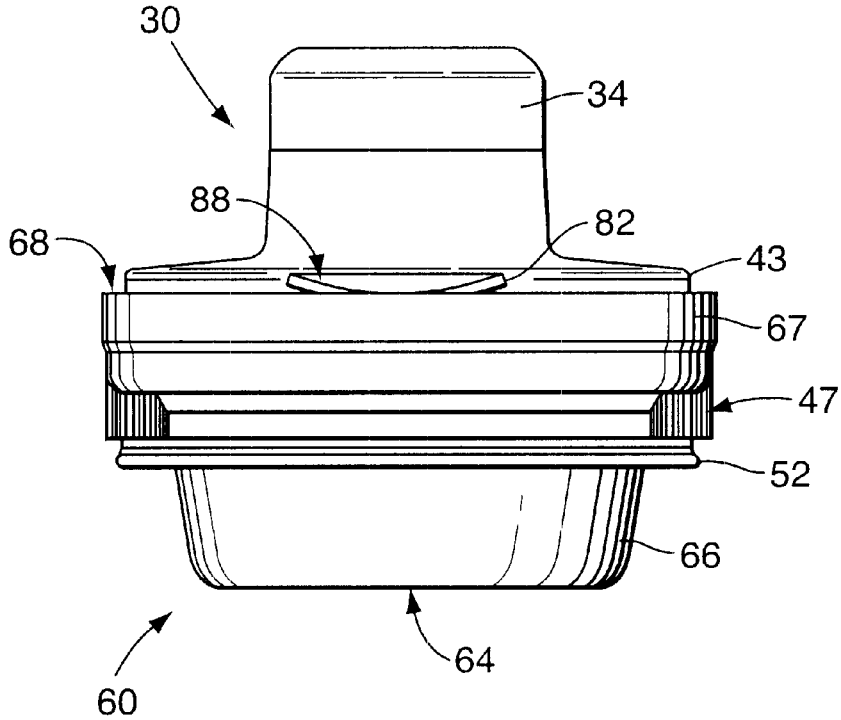
FIG. 9 is an elevational view of the right side of the exemplary lid and closure system shown in FIG. 1.
Figure 14:
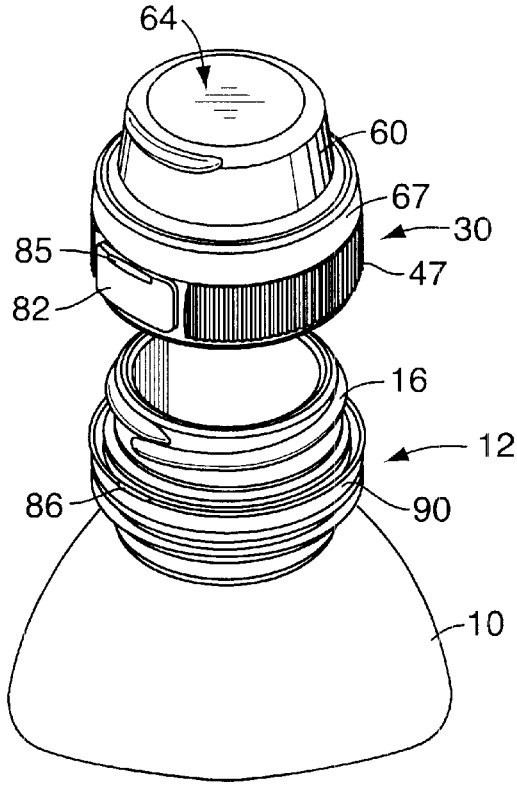
FIG. 14 is a perspective view of the exemplary closure system of FIG. 1 in a breached position in which the closure body has been unscrewed from the container and the tamper-evident member fractured, the container forming no part of the invention.

As best illustrated in FIGS. 1, 3 and 6, the exemplary drop ring 90 preferably includes an annular drop ring outer wall 93 extending downward from a closure body facing end 92 to an annular shoulder 96. The closure body facing end 92 is so-termed because, when the closure system 20 is assembled as described below, the closure body facing end 92 will face the closure body skirt bottom 48. As best shown in FIG. 6, the drop ring outer wall 93 is integral with inner drop ring retaining wall 94 which functions to retain the drop ring 90 on the container 10 (FIG. 14). A drop ring snap-fit bead 98 is provided on an inner surface of the drop ring outer wall 93 near the closure body facing end 92 and functions to retain the drop ring 90 on the closure body skirt bottom 67 (FIG. 15) when the closure system 20 is assembled. The annular drop ring retaining wall 94 provides an inwardly biased wall which may be deformed when the assembled closure system 20 is installed on a container as will be described.

As will be recognized, the lid skirt bottom 68, frangible tamper-evident member 80 and drop ring 90 have substantially coplanar portions in the as-molded configuration illustrated in FIG. 1, and therefore the exemplary lid 60 permits molding in a relatively simple manner compared to prior art tamper-evident lids. The term "substantially coplanar" is intended to describe a geometric relationship in which a substantial portion of the lid skirt bottom 68, frangible tamper-evident member 80 and drop ring 90 may be bounded by two hypothetical parallel geometric planes. The term "substantially coplanar" as used herein does not necessarily require that any particular surfaces on the skirt bottom 68, frangible tamper-evident member 80 or drop ring 90 are planar. For example, as will be recognized, the concave surface 88 of the frangible tamper-evident member 80 extends beyond the geometric plane defined by the planar surface of the lid skirt end 68, yet the frangible tamper-evident member 80, lid skirt end 68 and drop ring 90 in the exemplary closure system 20 are considered to be "substantially coplanar" within the intended meaning of that term. In other contemplated embodiments, none of the portions of the member 80, lid skirt end 68, and drop ring 90 need be substantially coplanar.

Assembly of the closure system 20 will now be described with reference to FIGS. 1 and 10–13. FIG. 1 illustrates the exemplary closure system 20 in an as-molded configuration as it would be removed from an injection molding device (not shown), the details of which are well-known in the art. After molding, the closure system 20 is manipulated, either by hand or by automated equipment, into an assembled configuration. FIG. 10 illustrates the closure system 20 in a first intermediate position in which the lid 60 has been moved to a closed position on the closure body 30. The frangible tether member 82 and the drop ring 90 are inverted compared to their position in FIG. 1.

The next step in the assembly process involves a pivotal movement of the frangible tether member 82 and drop ring 90 relative to the lid 60 to the position shown in FIG. 11. The weakened proximal end 85 of the frangible tether member 82 permits such movement. The frangible tether member 82 assumes a position alongside the closure body skirt 46 and within the member-receiving recess 45 formed therein. As can be seen in FIG. 11, the curvature of the frangible tether member 82 facilitates close positioning of the frangible tether member 82 relative to the outer surface of the closure body skirt 46.

In the next step in the assembly process, as shown in FIG. 12, the drop ring 90 is pivoted relative to the frangible tether member 82 and closure body 30. Eventually, the drop ring 90 is pivoted to the position shown in cross-section in FIG. 15 in which the closure body facing end 92 of the drop ring 94 is disposed adjacent the closure skirt bottom 67. The drop ring 90 is retained in this position by a snap-fit feature, which, in this exemplary embodiment, includes a drop ring snap-fit bead 98. In this exemplary embodiment, the closure body 30 is provided with a closure body skirt end snap-fit bead 52 which also functions to retain the drop ring 90 on the closure body.

Figure 15:
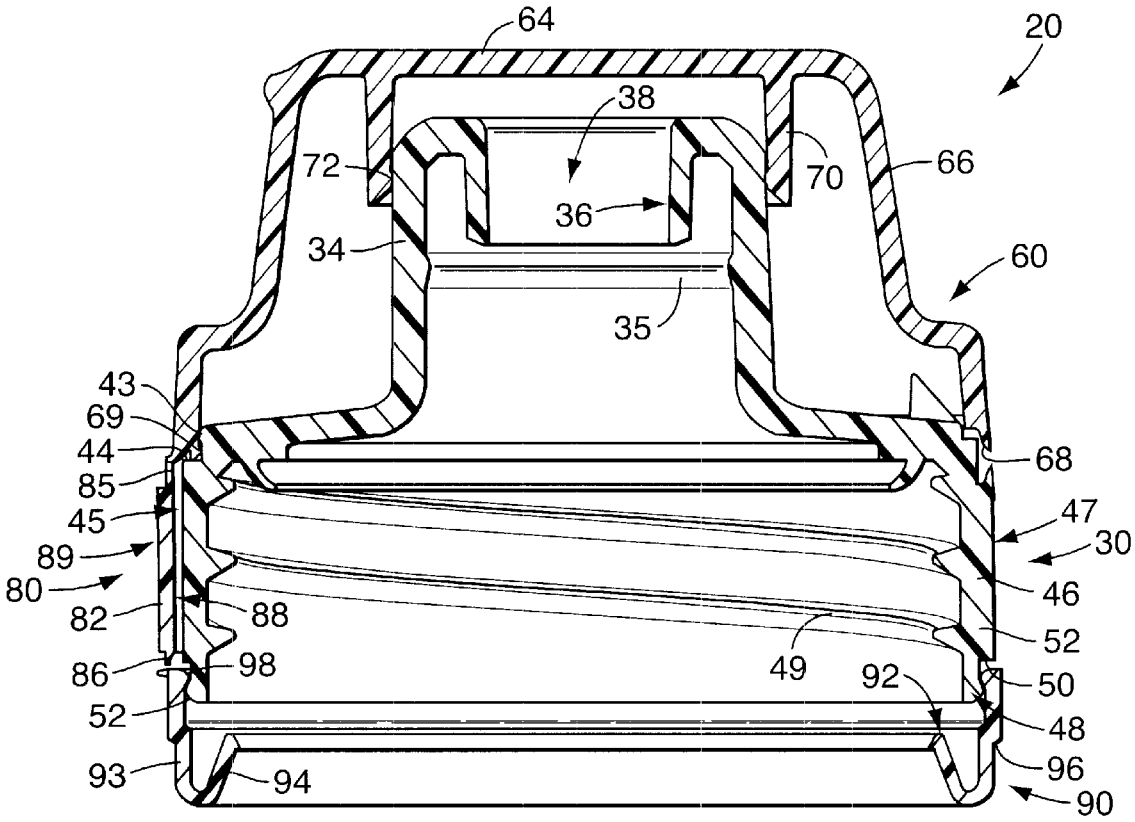
FIG. 15 is a cross-sectional view of the exemplary closure system of FIG. 1 taken along the plane defined by line 15—15 in FIG. 13.

After the closure system 20 has been manipulated into the assembled configuration shown in FIG. 15, it is installed on a container as shown in FIG. 13. As will be recognized by those of ordinary skill, the closure system 20 is threaded onto the container threads 16 (FIG. 14) and rotated in a clockwise direction (when viewed from the top). As the closure system 20 is threaded onto the container 10, the drop ring 90 encounters a drop ring retaining lip (not shown) and is deformed until it moves past the drop ring retaining lip and the drop ring 90 retained on the container 10. This is the installed, pre-tamper position.

As shown in FIG. 14, the frangible tether member 82 will evidence movement of the closure body 30 relative to the container 10. Specifically, when the closure body 30 is rotated in a counterclockwise direction, the closure body 30 will move upward as it is unscrewed from the container threads 16. The drop ring 90, however, will be retained on the container 10 by the drop ring retaining lip. Thus, rotation of the closure body 30 relative to the container 10 will result in fracture of the frangible tether member 82 as shown in FIG. 14.

In accordance with the invention, the frangible tether member 82 will also evidence movement of the closure lid 60 relative to the closure body when the closure system 20 is in the installed, pre-tamper position shown in FIG. 13. Specifically, movement of the lid 60 will result in a fracture of the frangible tether member 82 at one of the weakened portions, since the drop ring 90 and therefore the frangible tether member 82 are secured against movement relative to the container 10. Thus, the single tamper-evident feature in the form of the frangible tether member 82 will evidence tampering with two interfaces in the closure system: 1) the interface between the closure body 30 and the container 10, and 2) the interface between the lid 60 and the closure body 30.

It will be readily apparent from the foregoing detailed description of the invention and from the illustrations thereof that numerous variations and modifications may be effected without departing from the true spirit and scope of the novel concepts or principles of this invention.

For example, although the closure assembly of the invention is exemplified by a threaded engagement with the container, it will be recognized that other fastening techniques and implements may be used for securing the closure assembly to the container without departing from the spirit and scope of the invention.

It will also be recognized that the frangible tamper-evident member 80 may be alternatively attached to other portions of the lid 60 instead of the lid bottom portion 67. Moreover, although the embodiment described herein includes the frangible tamper-evident member 80 extending in a direction that is approximately 180-degrees from the center of hinge 62, it will be recognized that the frangible tamper-evident member 80 may also be located at other angular positions around the periphery of the lid 60, for example, at a position that is about 90-degrees from the center of hinge 62, without departing from the spirit and scope of the invention claimed herein.

It will also be recognized that the frangible nature of the frangible tamper-evident member 80 may be facilitated by other features. For example, instead of the proximal end 85 and distal end 86 being provided as reduced thickness portions, they may be provided with perforations or other features which provide a weakened area in the frangible tamper-evident member 80. Moreover, although two weakened portions of frangible tamper-evident member 80 are provided in the exemplary embodiment, it will be recognized that the invention contemplates frangible tamper-evident members which include only one weakened area as well as frangible tamper-evident members which may include more than two weakened areas.

What is claimed is:

1. A tamper-evident structure for use in a closure system, the closure system including a closure body for being directly engaged with a container that has a lip, said closure body having a dispensing orifice, the tamper-evident structure comprising:

(A) a lid for occluding the dispensing orifice, said lid having a first location at which said lid is integrally connected with a hinge to said closure body in a unitary construction;

(B) a frangible tamper-evident member extending from a proximal end adjacent the lid to a distal end opposite the proximal end, said proximal end of said tamper-evident member being integrally connected to said lid in a unitary construction at a second location on said lid that is spaced from said first location; and (C) a drop ring that is (1) attached to the distal end of the frangible tamper-evident member, and (2) adapted to engage the lip of the container in a way that inhibits upward movement of said drop ring beyond said lip of said container.

2. The tamper-evident structure of claim 1 adapted for use with a closure system having a closure body which has a deck around the dispensing orifice and a skirt extending from the body.

3. The tamper-evident structure of claim 2 adapted for use with a closure system having a closure body with a skirt that defines a skirt bottom, said frangible tamper-evident member being of sufficient length to enable the drop ring to be positioned on the closure body skirt bottom.

4. The tamper-evident structure of claim 1 wherein the frangible tamper-evident member includes at least one weakened portion.

5. The tamper-evident structure of claim 4 wherein the weakened portion is provided by an area of reduced thickness.

6. The tamper-evident structure of claim 1 wherein (1) the tamper-evident structure further comprises a lid skirt which is on the lid and defines a lid skirt bottom, (2) the drop ring includes an engaging surface for engaging said closure body, (3) the lid skirt bottom, frangible tamper-evident member and drop ring are molded as a unitary structure, and (4) the lid skirt bottom, frangible tamper-evident member, and drop ring engaging surface are substantially coplanar in an as-molded condition.

7. The tamper-evident structure of claim 1 wherein the drop ring is provided with a fastening feature for securing the drop ring to the closure body.

8. The tamper-evident structure of claim 7 wherein the fastening feature comprises a snap-fit feature on the drop ring.

9. The tamper-evident structure of claim 8 wherein the snap-fit feature includes a snap-fit bead on the drop ring for engaging a snap-fit groove on the closure body.

10. The tamper-evident structure of claim 1 wherein the frangible tamper-evident member is formed with a concave surface for being disposed adjacent the closure body skirt.

11. A tamper-evident closure system for a container, the closure system comprising:

(A) a closure body for being directly engaged with a container that has a lip, said closure body having a skirt with a skirt bottom and defining a corresponding dispensing orifice for permitting flow through the closure body;

(B) a lid cooperatively associated with said closure body and adapted to be moved between (1) a closed position in which the lid engages the closure body to occlude the dispensing orifice, and (2) an open position in which the lid is spaced away from the closure body, said lid having a first location at which said lid is integrally connected with a hinge to said closure body in a unitary construction; and (C) a drop ring connected to the lid with a frangible tamper-evident member at a second location on said lid which is spaced from said first location, said tamper-evident member being of sufficient length to permit the drop ring to be positioned on the closure body skirt bottom only when the lid is in the closed position wherein the drop ring can be prevented from moving upwardly beyond said container lip.

12. The dispensing closure system of claim 11 wherein the tamper-evident member and the lid are integrally molded from a thermoplastic material to form a unitary construction.

13. The dispensing closure system of claim 11 wherein the closure body, lid and tamper-evident member are integrally molded to form a unitary construction.

14. The dispensing closure system of claim 11 wherein the drop ring and closure body skirt cooperate through a snap-fit bead and snap-fit groove to retain the drop ring on the closure body skirt bottom.

15. The dispensing closure system of claim 11 wherein the lid and closure body are connected through a snap-action hinge that is integrally molded with the body and lid to form a unitary construction.

16. A closure lid and tamper-evident feature combination for use on a closure system, the closure system including a closure body for being directly engaged with a container that has a lip, said closure body having a dispensing orifice, the combination comprising:

(A) a lid adapted to be moved between (1) a closed position in which the lid engages the closure body to occlude the dispensing orifice, and (2) an open position in which the lid is spaced away from the closure body, said lid having a first location at which said lid is integrally connected with a hinge to said closure body in a unitary construction; and (B) a tamper-evident feature integrally molded to form a unitary construction with the lid at a second location on said lid that is spaced from said first location and including:

(1) a drop ring; and (2) a frangible tamper-evident member (1) extending between the drop ring and the lid, and (2) having a length sufficient to permit the drop ring to be positioned on the bottom of the closure body below said container lip to prevent said drop ring from moving upwardly beyond said container lip.

17. A method of assembling a tamper-evident closure system comprising:

(A) integrally molding the closure system to form a unitary construction, the closure system including (1) a closure body having a dispensing orifice for permitting flow through the closure body, and a skirt defining a skirt bottom;

(2) a lid having an as-molded condition in which it is in an open position relative to said closure body, said lid being connected at a first location to said closure body; and (3) a tamper-evident feature extending from the lid and including:

(a) a frangible tamper-evident member affixed to the lid at a second location on said lid that is spaced from said first location; and (b) a drop ring affixed to the frangible tamper-evident member;

(B) moving the lid from the as-molded position to a closed position in which the lid engages the closure body and occludes the dispensing orifice; and (C) fastening the drop ring to the skirt bottom and thereby orienting the frangible tamper-evident member adjacent the skirt with the drop ring being effective to engage a lip on a container to which said closure system can be installed, the frangible tamper-evident member thereby tending to fracture upon relative movement of the lid relative to the closure body and upon relative movement of the closure body relative to the drop ring.

18. A tamper-evident closure system assembled according to the method of claim 17.

* * * * *